US007937012B2

(12) United States Patent
Kawai et al.

(10) Patent No.: US 7,937,012 B2
(45) Date of Patent: May 3, 2011

(54) ANGLE ADJUSTING DEVICE AND IMAGE FORMING APPARATUS

(75) Inventors: Mitsuhiro Kawai, Kanagawa (JP); Hayato Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1356 days.

(21) Appl. No.: 11/376,344

(22) Filed: Mar. 16, 2006

(65) Prior Publication Data

US 2006/0219852 A1 Oct. 5, 2006

(30) Foreign Application Priority Data

Mar. 17, 2005 (JP) ..... 2005-076323
Mar. 17, 2005 (JP) ..... 2005-076326

(51) Int. Cl.
*G03G 15/00* (2006.01)

(52) U.S. Cl. ..... 399/81; 399/110

(58) Field of Classification Search ..... 399/81, 399/110, 126; 248/923
See application file for complete search history.

(56) References Cited

U.S. PATENT DOCUMENTS

| | | | | |
|---|---|---|---|---|
| 5,649,188 | A | 7/1997 | Nomura et al. | |
| 6,644,611 | B1 * | 11/2003 | Tai | 248/292.13 |
| 7,583,518 | B2 | 9/2009 | Watanabe | |
| 7,634,212 | B2 * | 12/2009 | Asakawa | 399/107 |
| 2005/0226647 | A1 * | 10/2005 | Lee | 399/81 |

FOREIGN PATENT DOCUMENTS

| | | |
|---|---|---|
| JP | 3-21120 | 3/1991 |
| JP | 9-311736 | 12/1997 |
| JP | 2000-122561 | 4/2000 |
| JP | 2003-87685 | 3/2003 |
| JP | 2003-94763 | 4/2003 |
| JP | 3094733 | 4/2003 |
| JP | 2003-246114 | 9/2003 |
| JP | 2004-198741 | 7/2004 |

OTHER PUBLICATIONS

U.S. Appl. No. 11/846,214, filed Aug. 28, 2007, Sugawara, et al.
U.S. Appl. No. 11/623,502, filed Jan. 16, 2007, Watanabe.
Office Action issued Nov. 24, 2010, in Japan Patent Application No. 2005-076326.

* cited by examiner

*Primary Examiner* — David M Gray
*Assistant Examiner* — Gregory H Curran
(74) *Attorney, Agent, or Firm* — Oblon, Spivak, McClelland, Maier & Neustadt, L.L.P.

(57) ABSTRACT

An angle adjusting device configured to support an operations panel so that up and down rotation of the operations panel against an apparatus main body can be made in a designated angle range and configured to adjust a rotational angle of the operations panel in up and down directions against the apparatus main body, the angle adjusting device includes i) a fixing member fixed to the apparatus main body, ii) a rotation member where the operations panel is provided, the rotation member being provided to the fixing member so as to be rotated with respect to a designated rotation shaft in the designated angle range, iii) a lock mechanism configured to lock rotation of the rotation member against the fixing member with respect to the rotation shaft, at one or more parts in the designated angle range, by using a force other than a frictional force between the fixing member and the rotation member, and iv) a setting mechanism configured to set a lock-on state and lock-off state of the lock mechanism.

8 Claims, 10 Drawing Sheets

ANGLE ADJUSTING DEVICE AND IMAGE FORMING APPARATUS

BACKGROUND OF THE INVENTION

1. Field of the Invention

The present invention generally relates to angle adjusting devices and image forming apparatuses, and more specifically, to an angle adjusting device configured to adjust a rotational angle of an operations panel in up and down directions against an apparatus main body and an image forming apparatus having the above-mentioned angle adjusting device.

2. Description of the Related Art

An operations panel is provided in recent image forming apparatuses such as a copier or a printer. A command of a user for implementing a job is input by the operations panel and a status of a main body of an image forming apparatus is displayed in the operations panel.

Generally, this operations panel is fixed to a housing (main body housing) where respective structural parts of the image forming apparatus are received. However, if the operations panel is fixed, unexpected image may be generated due to positional relationship between a viewpoint of the user and a lighting apparatus in a room, so that visibility of (ability to view) the operations panel may be degraded.

Japanese Laid-Open Patent Application Publication NO. 2004-198741 discloses an image forming apparatus having an angle adjusting device whereby an angle of an operations panel can be adjusted so that the visibility can be improved, and thereby the above-mentioned problem can be avoided.

However, in the image forming apparatus disclosed in Japanese Laid-Open Patent Application Publication NO. 2004-198741, it is assumed that the image forming apparatus is used while the adjusted angle of the operations panel is maintained. Therefore, it is not always sufficiently implemented that an angle of the operations panel is adjusted properly for every user in a case where the image forming apparatus is located in an environment where the public can use it. In addition, for a disable person who needs a supporting device such as a wheelchair, it may be necessary to view and operate the operations panel from a lower position.

SUMMARY OF THE INVENTION

Accordingly, it is a general object of the present invention to provide a novel and useful angel adjusting device and image forming apparatus.

It is also an object of the present invention is to provide an angle adjusting device whereby an operations panel can be set at an angle for a user by a simple operation without making the size of the device large.

It is also an object of the present invention is to provide an image forming apparatus whereby good visibility and operability of the operations panel can be secured.

The above object of the present invention is to provide an angle adjusting device configured to support an operations panel so that up and down rotation of the operations panel against an apparatus main body can be made in a designated angle range and configured to adjust a rotational angle of the operations panel in up and down directions against the apparatus main body, the angle adjusting device including:

a fixing member fixed to the apparatus main body;

a rotation member where the operations panel is provided, the rotation member being provided to the fixing member so as to be rotated with respect to a designated rotation shaft in the designated angle range;

a lock mechanism configured to lock rotation of the rotation member against the fixing member with respect to the rotation shaft, at one or more parts in the designated angle range, by using a force other than a frictional force between the fixing member and the rotation member; and a setting mechanism configured to set a lock-on state and lock-off state of the lock mechanism.

The above object of the present invention is also to provide an image forming apparatus configured to form an image based on a command input by a user, the image forming apparatus including:

an operations panel by which the command is input;

an image forming apparatus main body configured to form the image based on the command input by the operations panel; and an angle adjusting device, the angle adjusting device being configured to support the operations panel so that up and down rotation of the operations panel against an apparatus main body can be made in a designated angle range and configured to adjust a rotational angle of the operations panel in up and down directions against the apparatus main body, the angle adjusting device including:

a fixing member fixed to the apparatus main body;

a rotation member where the operations panel is provided, the rotation member being provided to the fixing member so as to be rotated with respect to a designated rotation shaft in the designated angle range;

a lock mechanism configured to lock rotation of the rotation member against the fixing member with respect to the rotation shaft, at one ore more parts in the designated angle range, by using a force other than a frictional force between the fixing member and the rotation member; and a setting mechanism configured to set a lock-on state and lock-off state of the lock mechanism.

The above object of the present invention is also to provide an angle adjusting device configured to support an operations panel so that up and down rotation of the operations panel against an apparatus main body can be made in a designated angle range and configured to adjust a rotational angle of the operations panel in up and down directions against the apparatus main body, the angle adjusting device including:

a fixing member fixed to the apparatus main body;

a rotation member where the operations panel is provided, the rotation member being provided to the fixing member so as to be rotated with respect to a designated rotation shaft in the designated angle range;

a lock mechanism configured to lock rotation of the rotation member against the fixing member with respect to the rotation shaft, at plural parts in the designated angle range; and a lever reciprocating in a designated shaft direction and setting a lock-on state and a lock-off state of the lock mechanism by a moving position.

The above object of the present invention is also to provide an image forming apparatus configured to form an image based on a command input by a user, the image forming apparatus including:

an operations panel by which the command is input;

an image forming apparatus main body configured to form the image based on the command input by the operations panel; and an angle adjusting device, the angle adjusting device being configured to support the operations panel so that up and down rotation of the operations panel against an apparatus main body can be made in a designated angle range and configured to adjust a rotational angle of the operations panel in up and down directions against the apparatus main body, the angle adjusting device including:

a fixing member fixed to the apparatus main body;

a rotation member where the operations panel is provided, the rotation member being provided to the fixing member so as to be rotated with respect to a designated rotation shaft in the designated angle range;

a lock mechanism configured to lock rotation of the rotation member against the fixing member with respect to the rotation shaft, at plural parts in the designated angle range; and a lever reciprocating in a designated shaft direction and setting a lock-on state and a lock-off state of the lock mechanism by a moving position.

Other objects, features, and advantages of the present invention will become more apparent from the following detailed description when read in conjunction with the accompanying drawings.

DETAILED DESCRIPTION OF THE PREFERED EMBODIMENTS

A description of the present invention is now given, with reference to FIG. 1 through FIG. 10, including embodiments of the present invention.

Figure 1:
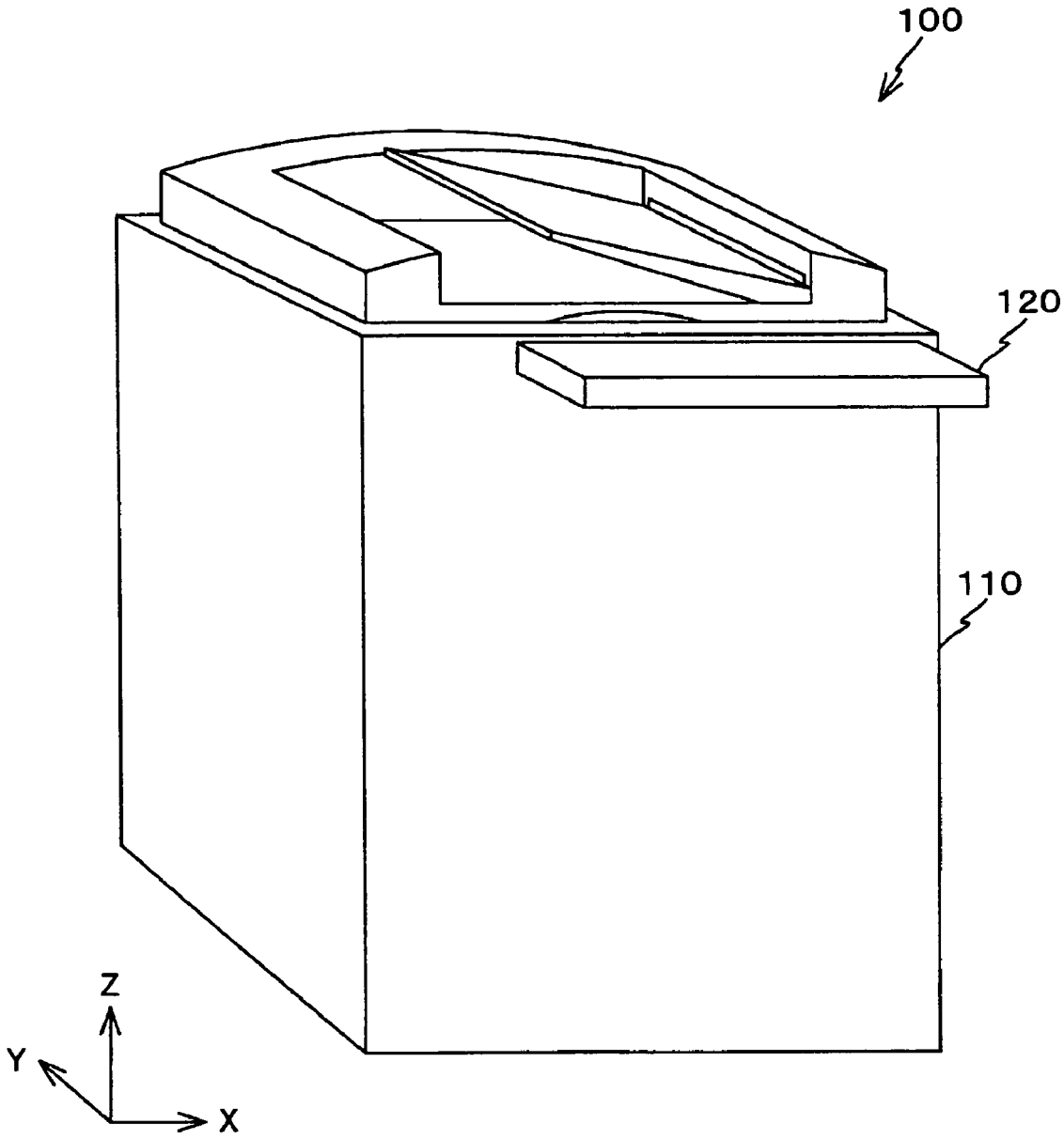
FIG. 1 is a perspective view of a copier of an embodiment of the present invention.

FIG. 1 is a perspective view of a copier 100 as an image forming apparatus of an embodiment of the present invention. The copier 100 includes an operations panel 120, a copier main body 110, and others. The operations panel 120 has an interface by which an user can input a command. The copier main body 110 has a substantially rectangular parallelepiped-shaped configuration. Based on the command input via the operations panel, an image of a manuscript that is a subject of copying is read out so as to be transferred to a paper by the copier main body 110.

Figure 2:
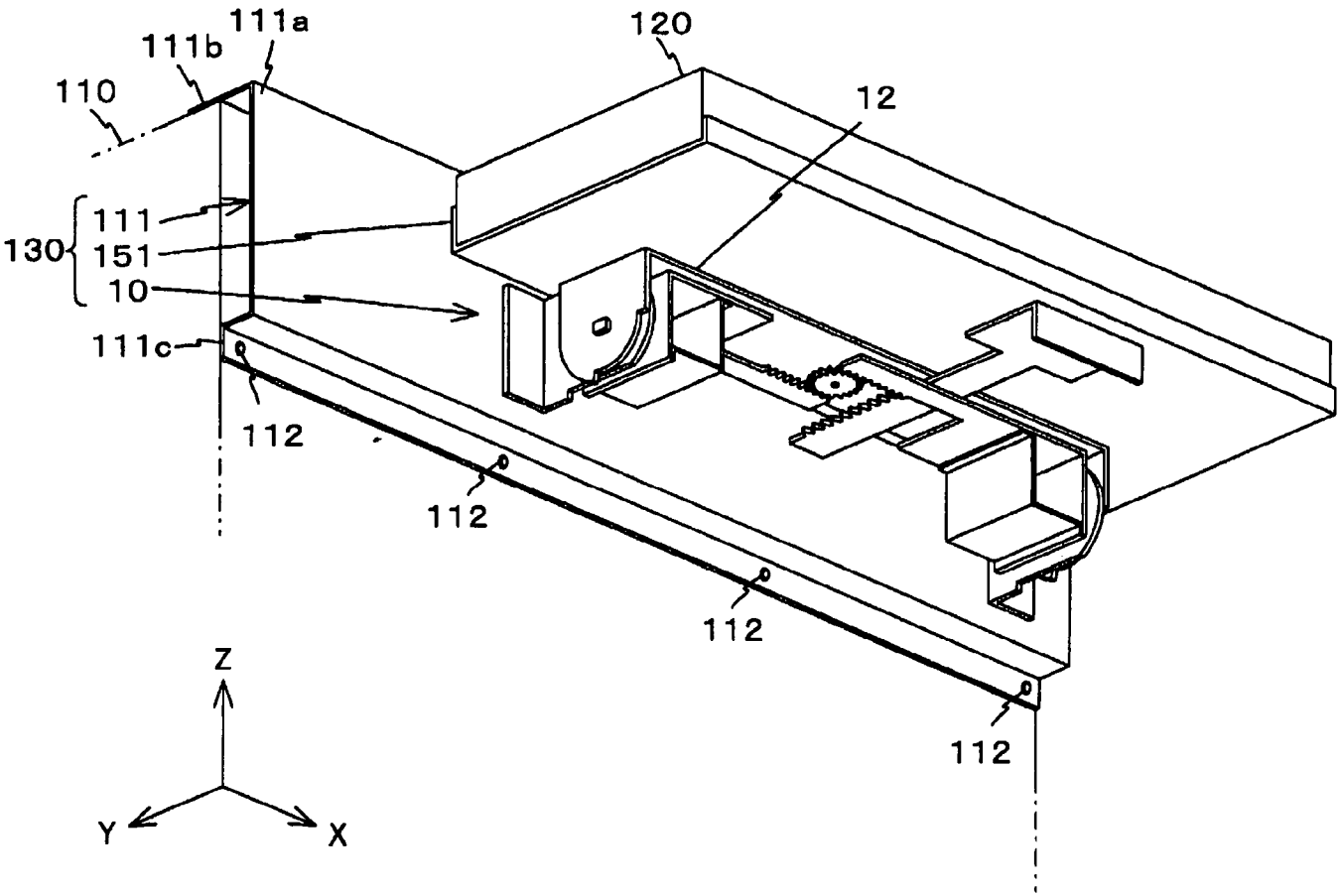
FIG. 2 is a perspective view of an angle adjusting mechanism configured to support an operations panel of the copier shown in FIG. 1.

FIG. 2 is a perspective view of an angle adjusting mechanism configured to support an operations panel 120 of the copier 100 shown in FIG. 1. As shown FIG. 2, the operations panel 120 is attached to the copier main body 110 via an angle adjusting device 130.

The angle adjusting device 130, as shown in FIG. 2, includes a base plate 111, a tilt mechanism 10, an attaching plate 151, and others. The base plate 111 is fixed in the vicinity of an upper end part of a front surface (a surface at a −Y side) of the copier main body 110. The tilt mechanism 10 is attached at a front surface (a surface at a −Y side) of the base plate 111. The attaching plate 151 is fixed on an upper surface of the rotation frame 12 forming the tilt mechanism 10. The operations panel 120 is attached on an upper surface of the attaching plate 151.

The base plate 111 is formed by processing a metal plate having, for example, a rectangular-shaped configuration. The base plate 111 includes a first bending part 111*b* situated at an upper end part of the base plate 111, a second bending part 111*c* situated at a lower end part of the base plate 111, and a base part 111*a* intermediate between the first bending part 111*b* and the second bending part 111*c*.

The first bending part 111*b* of the base plate 111 is fixed to an upper surface front end part of the copier main body 110 by a screw or the like not shown in FIG. 2. The second bending part 111*c* is fixed to a front end surface of the copier main body 110 by, for example, four screws 112. Under this structure, the base plate 111 is fixed on an upper part of a front part of the copier main body 110. The tilt mechanism 10 is attached on a front surface of the base part 111*a* as discussed below.

Figure 3:
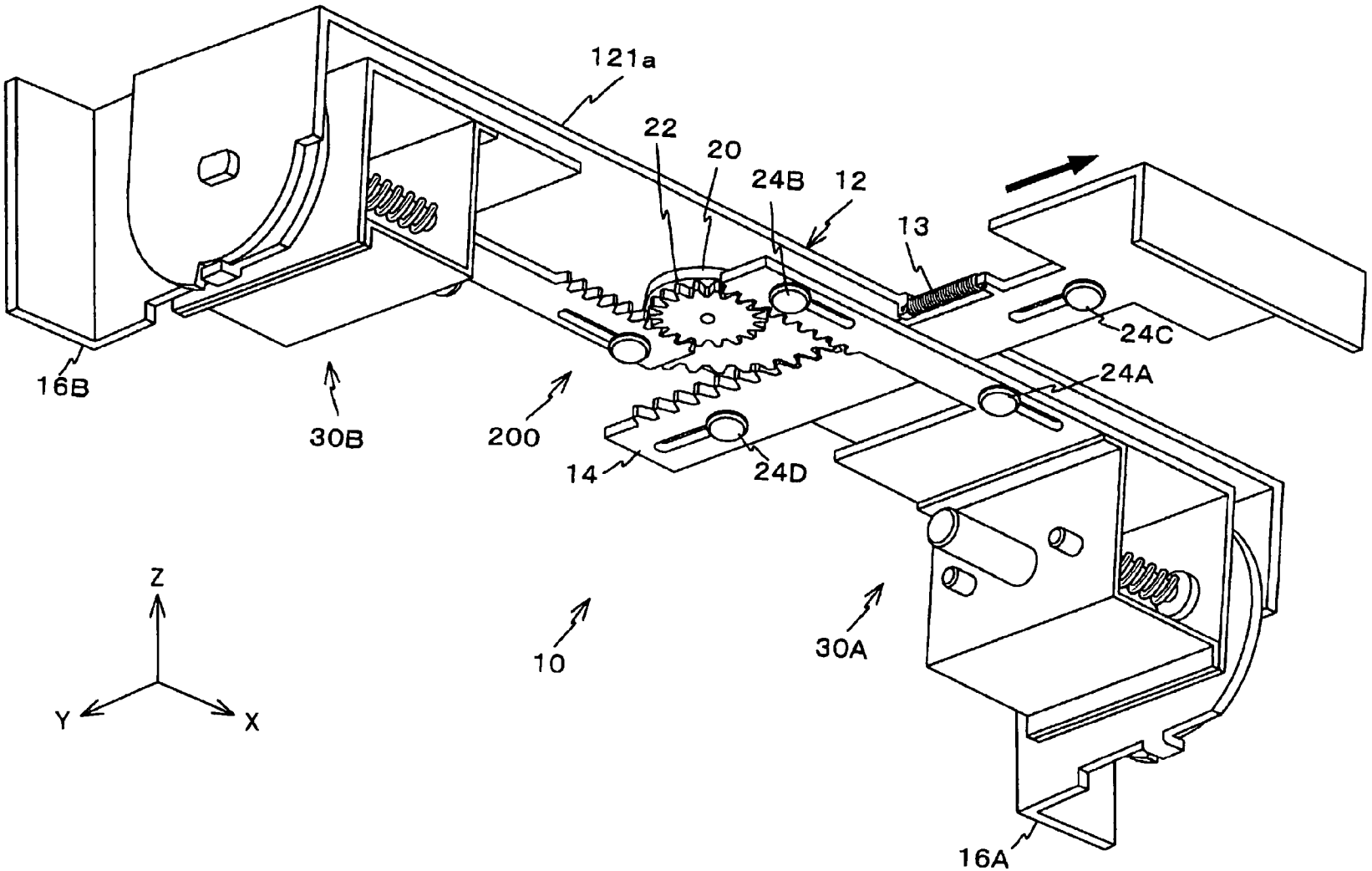
FIG. 3 is a perspective view of a tilt mechanism shown in FIG. 2.

FIG. 3 is a perspective view of the tilt mechanism 10 shown in FIG. 2.

As shown expanded in FIG. 3, the tilt mechanism 10 includes supporting plates 16A and 16B, the rotation frame 12, lock mechanisms 30A and 30B, a setting mechanism 200, and others. The supporting plates 16A and 16B forms a fixing member. Both end parts in a longitudinal direction (X axis direction) of the arm shaped rotation frame 12 is rotatably supported by the supporting plates 16A and 16B. The lock mechanisms 30A and 30B obstruct rotation (relative rotation) of the rotation frame 12 against the supporting plates 16A and 16B. The setting mechanism 200 includes a handle 14 provided movably in the Y axis direction. The setting mechanism 200 sets lock-on and lock-off states of the lock mechanism 30A and 30B as being connected with movement of the handle 14.

Figure 4:
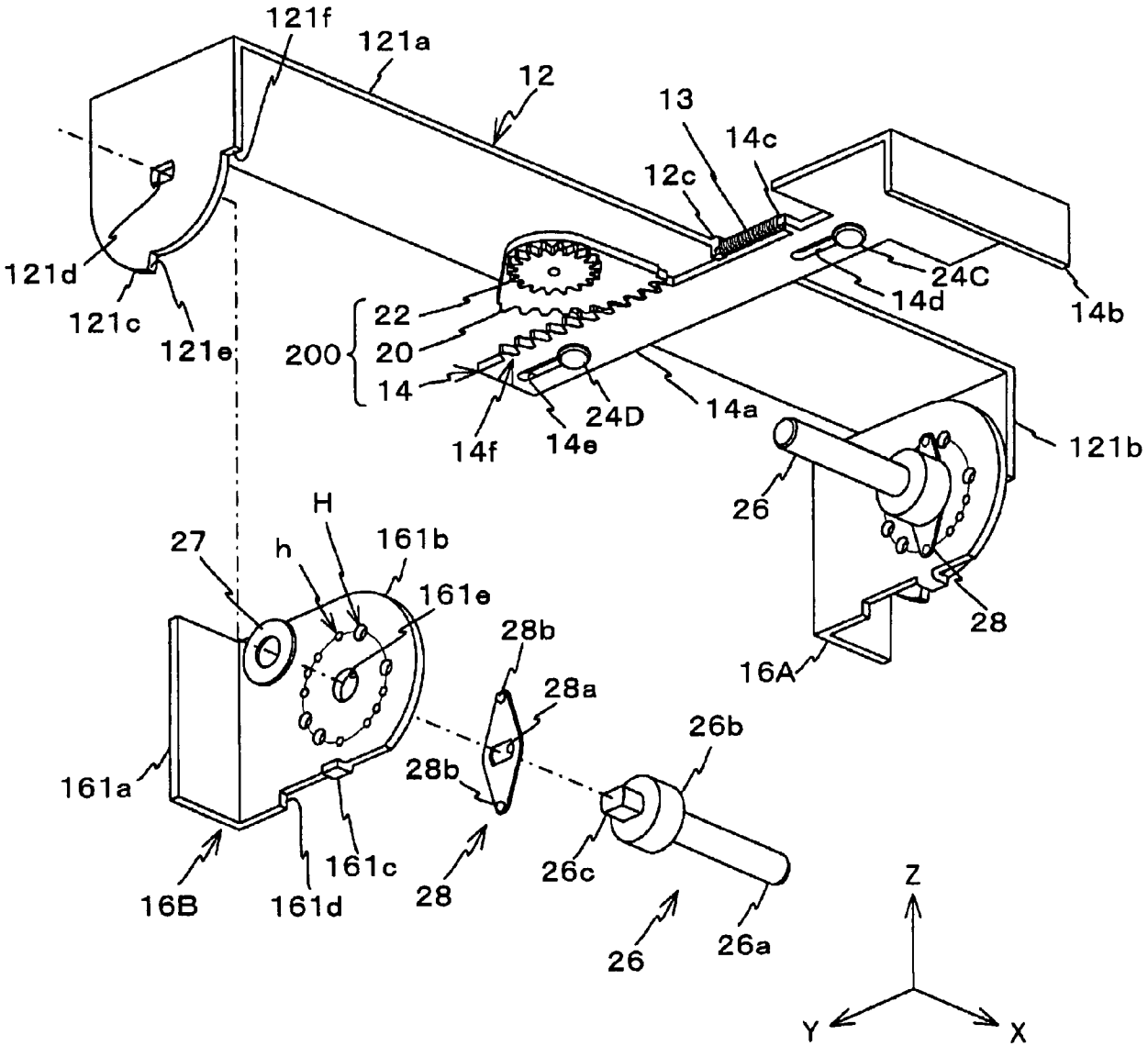
FIG. 4 is an exploded perspective view of a rotation frame, a supporting plate and a setting mechanism of the tilt mechanism shown in FIG. 3.

FIG. 4 is an exploded perspective view of the rotation frame 12, the supporting plates 16A and 16B and the setting mechanism 200 of the tilt mechanism 10 shown in FIG. 3.

The supporting plate 16B, as shown in the expanded perspective view of FIG. 4, is formed by a plate member having an L-shaped XY (in the XY plane) cross section. The supporting plate 16B includes a first part 161*a* having a rectangular plate-shaped configuration and a second part 161*b* having a tongue-shaped configuration. The second part 161*b* extends from an end part at a +X side of the first part 161*a* in FIG. 4 in parallel with a YZ surface. In the supporting plate 16B, a back surface, namely a surface at a +Y side of the first part 161*a* is fixed to a front surface of the base part 111*a*. See FIG. 2.

As shown in FIG. 4, a circular-shaped hole 161*e* is formed in the second part 161*b*. Four circular-shaped holes H having diameters smaller than the diameter of the circular-shaped hole 161*e* and eight circular-shaped holes h having diameters smaller than the diameters of the circular-shaped holes H are formed along a circumference of a circle having a diameter greater than the diameter of and concentric about the circular-shaped hole 161*e*. The arrangement of the circular-shaped holes H and h is discussed below.

A step part 161*d* is formed on a lower end surface (a surface at a −Z side) of the second part 161*b*. An engaging claw 161*c* projecting outward (−X side) is provided in the center of the step part 161*d*.

While the supporting plate 16A is provided in line symmetry with the supporting plate 16B, the supporting plate 16A has the substantially same structure as that of the supporting plate 16B and is fixed to the front surface of the base part 111*a*. See FIG. 2.

As shown in FIG. 4, the rotation frame 12 includes a first part 121*a*, a second part 121*b* and a third part 121*c*. The first part 121*a* has a rectangular-shaped plate configuration parallel with the XY plane. The second part 121*b* and the third part 121*c* are bent from corresponding ends in a longitudinal direction of the first part 121*a* in parallel with the YZ plane. An opening 121*d* is formed in the center of the third part 121*c*. The opening 121*d* has a substantially rectangular-shaped configuration with rounded ends, and more specifically, a configuration of a remaining part formed by removing a bow-shaped part from a circular-shaped part. A lower half part of the third part 121*c* is formed in a half circular shape centered on the opening 121*d*. More specifically, one fourth circular shaped part from a three o'clock position to a six o'clock position, of the half circular shape configuration, is removed. Corresponding ends of the cut part form step parts 121*e* and 121*f*.

While the third part 121*c* is provided in line symmetric with the second plate 121*b*, the third part 121*c* has the substantially same structure as that of the second part 121*b*.

Figure 5:
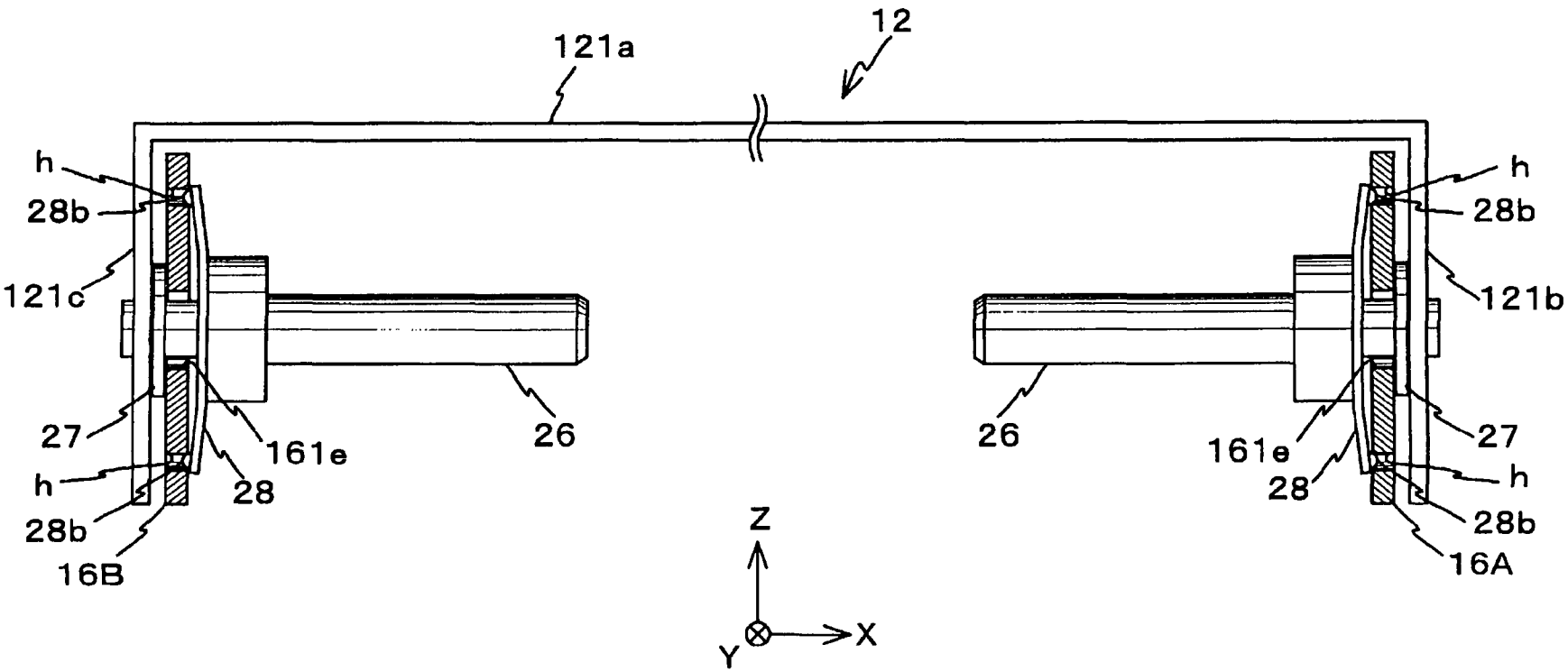
FIG. 5 is a view seen in a +Y direction of the rotation frame and the supporting plate of the tilt mechanism shown in FIG. 3.

FIG. 5 is a view seen in a +Y direction of the rotation frame 12 and the supporting plates 16A and 16B of the tilt mechanism 10 shown in FIG. 3.

As shown in FIG. 4 and FIG. 5, the rotation frame 12 is attached to the supporting plates 16A and 16B via washers 27 and plate spring 28 by connection stick 26 so as to be rotatably provided with respect to a rotation center of a center shaft of the connection sticks 26.

More specifically, the connection stick 26 connecting the third part 121*c* of the rotation frame 12 to the supporting plate 16B is, as shown in FIG. 4, formed by a substantially cylindrical-shaped member.

A large diameter part 26*b* having a diameter larger than other parts is provided in the vicinity of an end part in a longitudinal direction, namely −X side end part, of the connection stick 26. A small diameter part 26*a* is provided at a +X side of the large diameter part 26*b*. In addition, an engaging part 26*c* is provided at a −X side of the large diameter part 26*b*. The engaging part 26*c* has a cross section having the same configuration and size as the configuration and size of the opening 121*d*.

The plate spring 28 is made of spring steel having a substantially rhomboidal plate-shaped configuration. An opening 28*a* having the same configuration and size as the cross section of the engaging part 26*c* of the connection stick 26 is formed in the center of the plate spring 28. Convex parts 28*b* are formed, in addition, on a surface of the plate spring 28 facing the supporting plate 16B, symmetric with respect to a center of the opening 28*a*. The gap between the convex parts 28*b* is the same as the diameter of the circle having the circumference along which holes H and h are provided.

The washer 27 has an internal diameter in which the engaging part 26*c* of the connection stick 26 can be inserted via a designated clearance.

In this case, where the engaging part 26*c* of the connection stick 26 is pressed in the opening 28*a* of the plate spring 28 so that the plate spring 28 comes in contact with a surface of an external side of the large diameter part 26*b* of the connection stick 26, the connection stick 26 and the plate spring 28 are unified (pressed together). The engaging part 26*c* of the connection stick 26 where the plate spring 28 is attached is inserted in the hole 161*e* of the supporting plate 16B and pressed in and engaged with the opening 121*d* of the third part 121*c* of the rotation frame 12 via the washer 27, so that the third part 121*c* of the rotation frame 12 is rotatably provided to the supporting plate 16B.

The second part 121*b* of the rotation frame 12 is connected to the supporting plate 16A by the connection stick 26 in the same way that the third part 121*c* of the rotation frame 12 is rotatably provided to the supporting plate 16B.

As shown in FIG. 5, the rotation frame 12 is rotatably attached to the supporting plates 16B and 16A. In this state, as easily found through FIG. 4, the rotation frame 12 can be rotated in an angle range of approximately 90 degrees between a first position in which the engaging claw 161*c* comes in contact with the step part 121*e* provided at the third part 121*c* and a second position in which the engaging claw 161*c* comes in contact with the step part 121*f* provided at the third part 121*c*. Since the supporting plates 16B and 16A are provided in right and left symmetry and the third part 121*c* and the second part 121*b* of the rotation frame 12 are provided in right and left symmetry, at a side of the supporting plate 16A, the engaging claw 161*c* comes in contact with the step parts 121*e* and 121*f* provided in the second part 121*b* at the first and second positions.

As shown in FIG. 5, the convex parts 28*b* of the plate spring 28 are inserted in the holes h formed in the supporting plates 16B and 16A.

Figure 6:
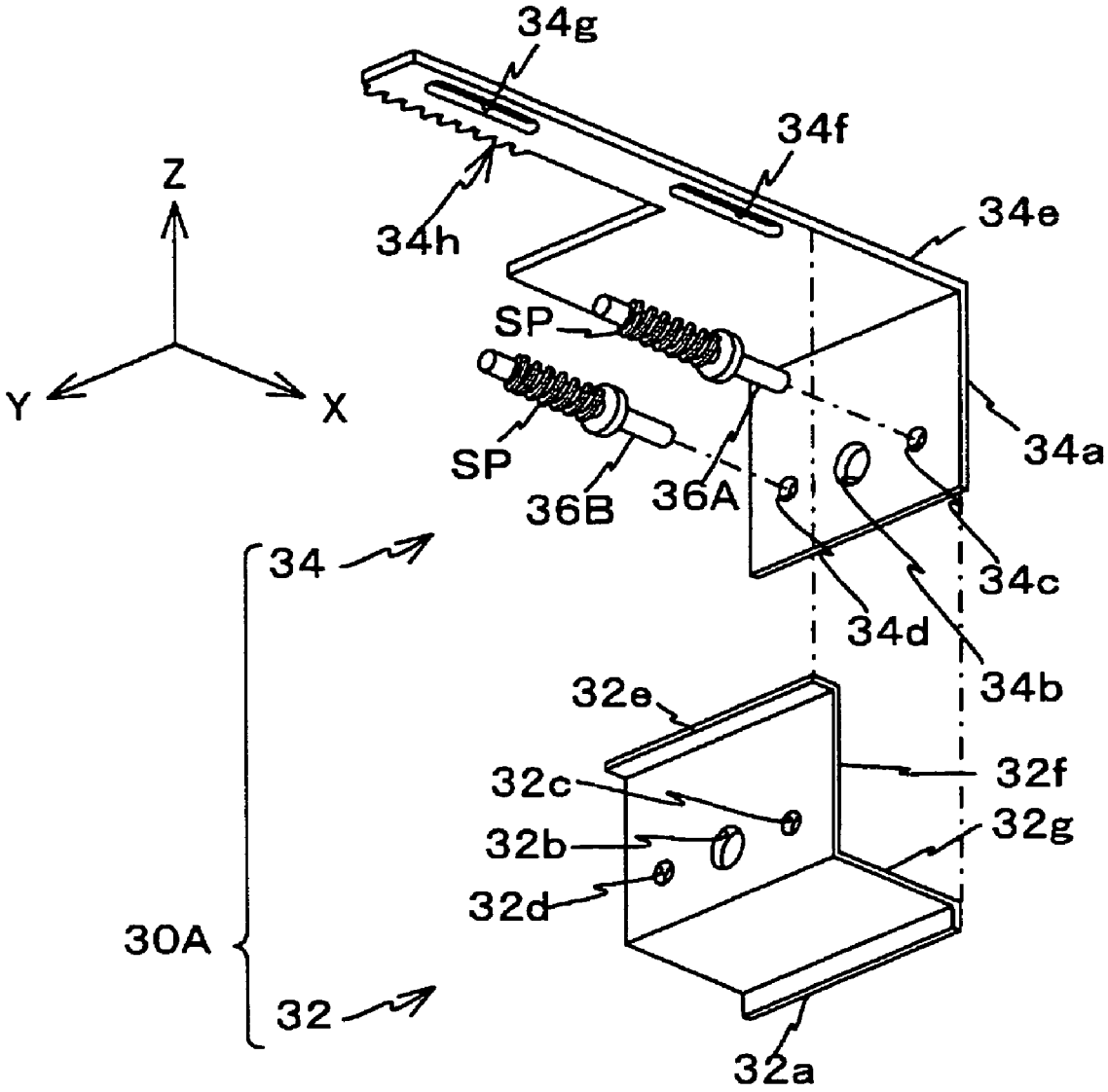
FIG. 6 is an exploded perspective view of a lock mechanism shown in FIG. 3.

As shown in FIG. 3, the lock mechanism 30A is attached on the first part 121*a* of the rotation frame 12 via two screws 24A and 24B. Meanwhile, FIG. 6 is an exploded perspective view of the lock mechanism shown 30A in FIG. 3. As shown in FIG. 6, this lock mechanism 30A includes the first member 34, the second member 32, lock pins 36A and 36B, and others.

The first member 34, as shown in FIG. 6, is formed by a plate member having an L-shaped XZ cross section. The first member 34 includes an upper plate part 34*e* and a wall side part 34*a* extending downward from a +X side end part of the upper plate part 34*e*. In the upper plate part 34*e*, elongated holes 34*f* and 34*g* are formed in an X axis direction with a designated gap in between. A part of an end part at a −Y side of the upper plate part 34*e* projects to an −X side more than other parts. The elongated holes 34*f* and 34*g* are formed in a belt part including the projections. A tooth part 34*h* is provided in a surface at a +Y side of the projection. As shown in FIG. 3, shaft parts of the screws 24A and 24B are inserted from a lower side into the elongated holes 34*f* and 34*g* provided in the upper plate part 34*e* of the first member 34, so that the screws 24A and 24B are screw-fixed with screw holes formed in the first part 121*a* of the rotation frame 12, and the first member 34 is supported from the lower side by head parts of the screws 24A and 24B. By relative movement of the screws 24A and 24B along the elongate holes 34*f* and 34*g* of the first member 34, the whole of the lock mechanism 30A can be reciprocally moved in the X axis direction against the rotation frame 12.

Referring back to FIG. 6, two holes 34*c* and 34*d* are formed in the side wall part 34*a* of the first member 34 in a Y axis direction with a designated gap. Ends of the lock pins 36A and 36B are inserted into holes 34*c* and 34*d* via designated clearance. A hole 34*b* having a diameter greater than the diameter of the small diameter part 26*a* of the connection stick 26 is formed in the center between the holes 34*c* and 34*d*.

The second member 32 is formed by a plate member having an L-shaped XZ cross section. The second member 32 includes a bottom plate part 32*g* having a rectangular plate shaped configuration parallel with the XY surface and a wall side part 32*f* standing from an end part at a −X side of the bottom plate part 32*g* in parallel with a YZ surface.

A bending end part 32*a* slightly projecting downward is provided at an end part at a +X side of the bottom plate part 32*g*. A bending end part 32*e* slightly projecting to a −X side is provided at an upper end part of the side wall part 32*f*. The bending end parts 32*a* and 32*e* are fixed to the side wall part 34*a* and the upper plate part 34*e* of the first member 34 so that the second member 32 and the first member 34 are unified. See FIG. 7.

In the side wall part 32*f* of the second member 32, holes 32*c* and 32*d* are formed so as to face two holes 34*c* and 34*d* formed in the side wall part 34*a* of the first member 34. Other ends of the lock pins 36A and 36B can be inserted in the holes 32*c* and 32*d* via designated clearance. A hole 32*b* having a diameter greater than the diameter of the small diameter part 26*a* of the connection stick 26 is formed in the center between the holes 34*c* and 34*d*. The lock mechanism 30A is attached to the supporting plate 16A where the small diameter part 26*a* of the connection stick 26 is inserted in the hole 34*b* of the first member 34 and the hole 32*b* of the second member 32.

Figure 7:
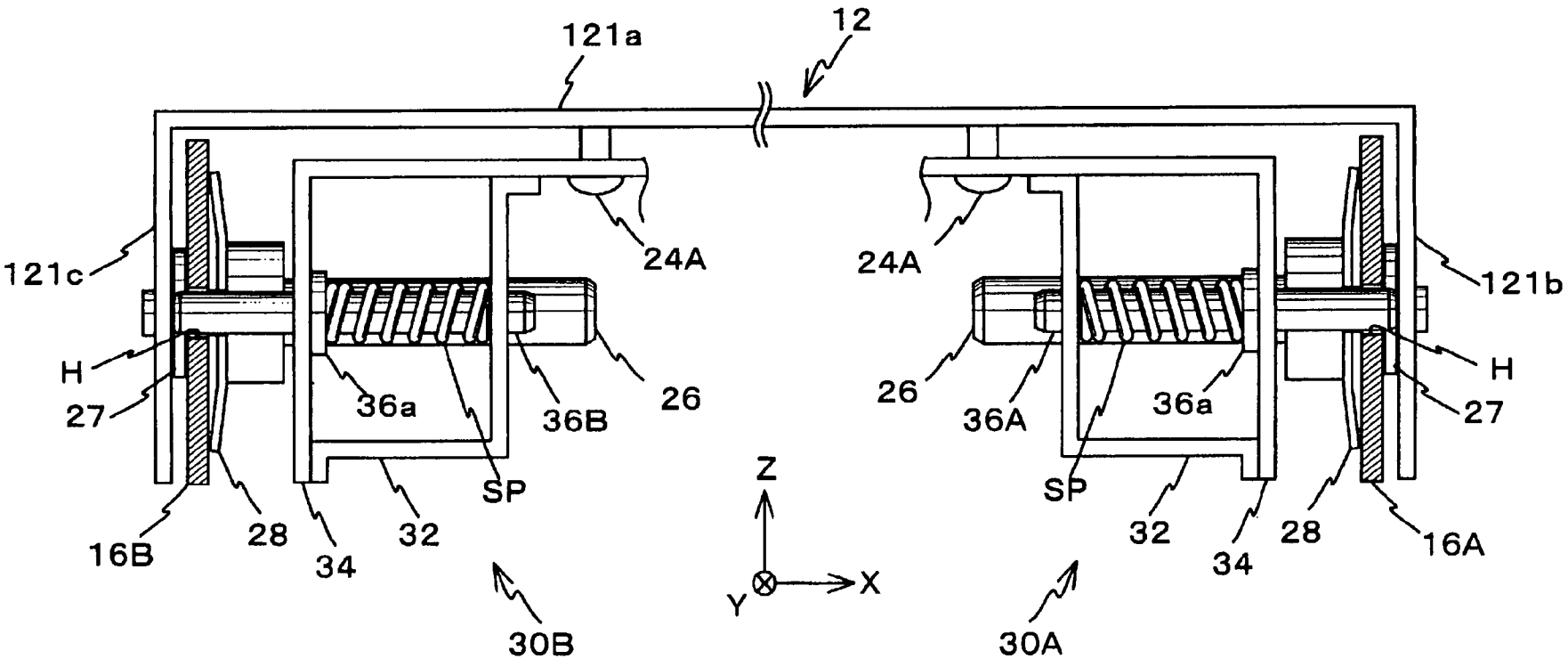
FIG. 7 is a view seen in a +Y direction of the lock mechanism shown in FIG. 3.

The lock pins 36A and 36B have substantially cylindrical-shaped configurations. Both end surfaces in a longitudinal direction of the lock pins 36A and 36B are chamfered and processed into a taper shape. Brim parts 36*a* thicker than other parts are provided at a part at +X side from the center of the lock pins 36A and 36B, as shown in FIG. 6 and FIG. 7.

Still referring to lock mechanism 30A, ends of the lock pins 36A and 36B are inserted in the holes 34*c* and 34*d* of the first member 34. Other ends of the lock pins 36A and 36B are inserted in the holes 32*c* and 32*d* of the first member 34. Therefore, the lock pins 36A and 36B can be moved along the X axis in a designated stroke (range). A spring (compression spring) SP as energizing means is provided at external circumferential parts at the −X side of the brim parts 36*a* of the lock pins 36A and 36B. As shown in FIG. 7, the spring SP is installed between the brim part 36*a* and the second member 32. The lock pins 36A and 36B are always energized outward (in a direction where the brim part 36*a* is pushed against the first member 34) by an elastic force of this spring SP. At least an end part facing the supporting plate 16A of the lock pins 36A and 36B is taper-processed and processed into a half spherical shape, for example.

While the lock mechanism 30B is provided in line symmetry with the lock mechanism 30A, the lock mechanism 30B has the substantially same structure as that of the lock mechanism 30A and is attached to the supporting plate 16B.

As shown in FIG. 3, the setting mechanism 200 includes a first gear 22, a second gear 20, and a lever 14. The first gear 22 meshes with the tooth part 34*h* of the first member 34 forming the lock mechanisms 30A and 30*b*. The second gear 20 is fixed to the upper surface of the first gear 22 and rotatably attached to the lower surface of the first part 121*a* of the rotation frame 12 so as to be rotated together with the first gear 22. The lever 14 works as a turning-off lever, whose longitudinal direction is a Y axis direction, meshing with the second gear 20.

As shown in FIG. 4, the first gear 22 and the second gear 20 are attached in the vicinity of the center of the lower surface (−Z side surface) of the first part 121*a* of the rotation frame 12 via a common shaft.

The lever 14, as shown in FIG. 4, includes a main body part 14*a* having a substantially T-shaped configuration seen from a lower side and a grip part 14*b*. The grip part extends from a −Y side end part of the main body part 14*a* to a lower side. Two elongated holes 14*d* and 14*e* whose longitudinal direction is along the Y axis are formed with a designated gap in the main body part 14*a*. Shaft parts of the screws 24C and 24D are inserted from a lower side into the elongated holes 14*d* and 14*e*, so that the screws 24C and 24D are screwed into screw holes formed in the lower surface of the attaching plate 151 and the lever 14 is supported from the lower side by head parts of the screws 24C and 24D. By relative movement of the screws 24C and 24D along the elongate holes 14*d* and 14*e* of the main body part 14*a*, the lever 14 can be reciprocally moved in the Y axis directions against the rotation frame 12 and the attaching plate 151.

As shown in FIG. 4, the engaging part 14*c* projects from the −X side of the main body part 14*a* of the lever 14. One end of a tensile spring 13 is connected to the engaging part 14*c*. The tensile spring 13 has a spring constant sufficiently larger than that of the spring SP. The other end of the tensile spring 13 is connected to an engaging part 12*c*. The engaging part 12*c* projects downward from the vicinity of the center of the −Y side end part of the first part 121*a* of the rotation frame 12. Because of this, the lever 14 is always energized to the +Y side by the elastic force of the tensile spring 13.

The tooth part 14*f* is formed on the −X side surface of the main body 14*a* of the lever 14 so that the tooth part 14*f* is meshed with the second gear 20.

The attaching plate 151 is formed by a plate whose YZ surface in FIG. 2 has a substantially U shaped configuration. The attaching plate 151 is formed by bending a metal plate. A bottom surface of the attaching plate 151 is fixed to an upper surface of the first part 121*a* of the rotation frame 12 forming the above-mentioned tilt mechanism 10. The operations panel 120 is inserted from an upper side to fit between the bending parts at +Y side and −Y sides of the attaching plate 151.

Figure 8:
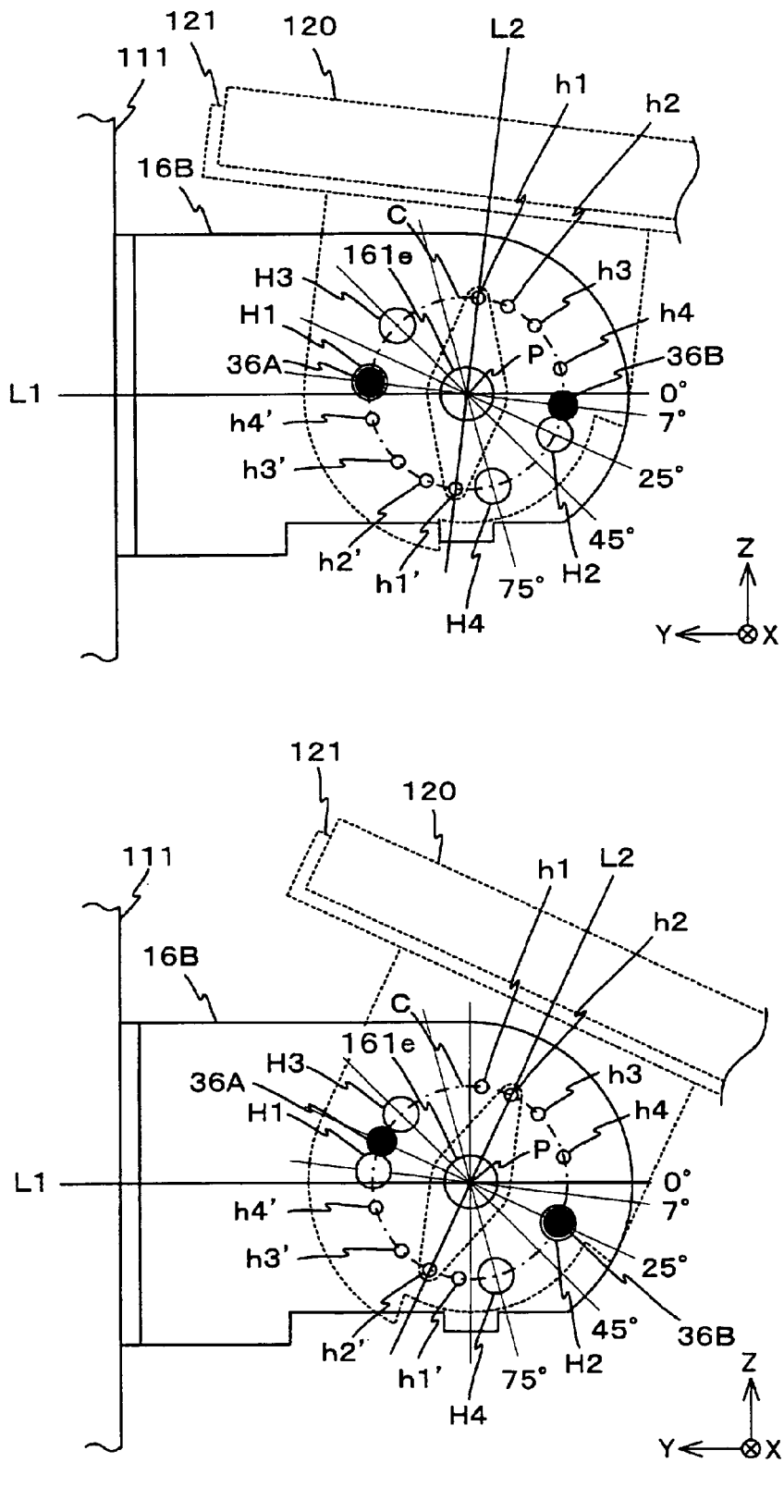
FIG. 8 is a first view for explaining an arrangement position of a circular-shaped hole.
Figure 9:
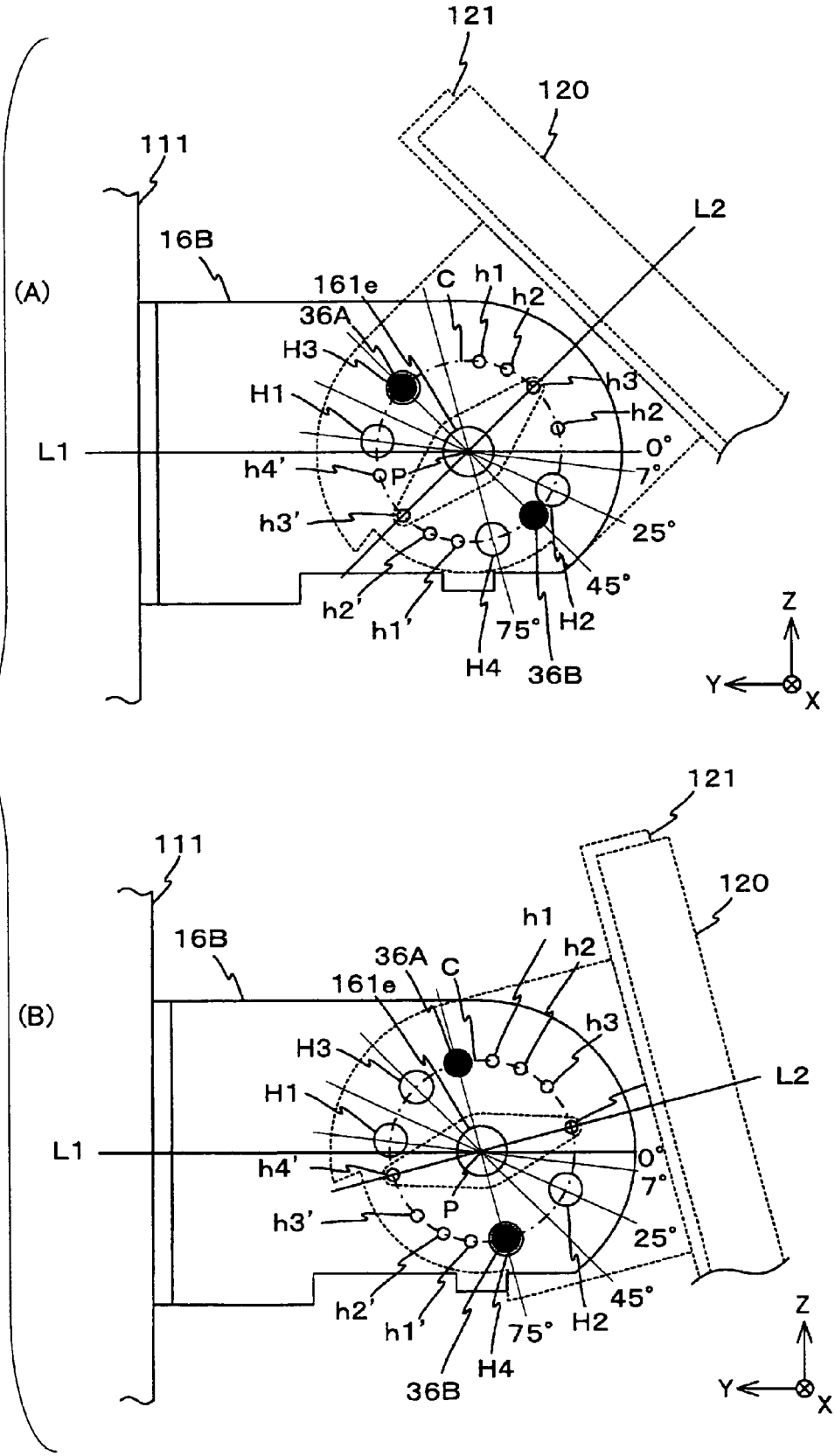
FIG. 9 is a second view for explaining the arrangement position of the circular-shaped hole.

Arrangement of the holes H and h formed in the supporting plates 16A and 16B are discussed with reference to FIG. 8-(A) through FIG. 9-(B) by using the supporting plate 16B as an example. Here, FIG. 8 is a first view for explaining an arrangement position of the circular-shaped hole and FIG. 9 is a second view for explaining the arrangement position of the circular-shaped hole. More specifically, FIG. 8 and FIG. 9 are side views of the supporting plate 16B seen from −X side to +X side. In FIG. 8 and FIG. 9, a part of the base plate 111 is shown by solid lines and the operations panel 120 attached to the rotation frame 12 via the attaching plate 151 is shown by dotted lines. Furthermore, in FIG. 8 and FIG. 9, two lock pins 36A and 36B are shown by black circles.

A crossing point at a right side (−Y side) of crossing points formed by a straight line parallel to the Y axis passing through a rotation center P of the rotation of the rotation frame 12 and a circumference C where the engaging holes H and h are arranged, is defined as a 0 degree position. The clockwise direction along the circumference C from this point is defined as the +direction. A point made by rotating 7 degrees along the circumference C from the 0 degree position with respect to the rotation center P is called a 7 degrees position, and a point made by rotating at 25 degrees along the circumference C from the 0 degrees position with respect to the rotation center P is called a 25 degrees position. In addition, a line connecting the rotation center P and the 7 degrees position is called a 7 degrees line, and a line connecting the rotation center P and the 25 degrees position is called a 25 degrees line.

In a case where an angle formed by a standard surface, namely an XY surface parallel with a bottom surface where the copier 100 is arranged, and the bottom surface of the operations panel 120, that is an angle of the standard surface and the bottom surface of the attaching plate 151, is α degrees, the angle of the operations panel 120 against the copier main body 110 is called a "tilt angle α degrees". In this embodiment, as an example, the angle of the operations panel 120 against the copier main body 110 can be adjusted in phases by four tilt angles, namely a tilt angle 4 degrees, a tilt angle 25 degrees, a tilt angle 45 degrees, and a tilt angle 75 degrees. The present invention is not limited to the above-mentioned example. The tilt angles or the number of phases may be optionally changed.

The operations panel 120 at the tilt angle 7 degrees is shown in FIG. 8-(A). At this tilt angle, as discussed above, head ends of the lock pins 36B and 36A are situated in the 7 degrees position and 187 degrees position, respectively, which are crossing points of the 7 degree line and the circumference C. Therefore, the tilt angle of the operations panel 120 can be maintained at 7 degrees by locking the head ends of the lock pins 36A and 36B against the supporting plate 16B at the 7 degrees position or 187 degrees position. In this case, the hole H1 with which the lock pin 36A is engaged is formed in the 187 degrees position. In addition, the plate spring 28 arranged so that the straight line L2 connecting convex parts 28*b* is perpendicular to the operations panel 120. Because of this, in a case where the operations panel 120 is held at the tilt angle 7 degrees, the convex parts 28*b* are in 97 degrees position and 277 degrees position on the circumference C. Therefore, the holes h1 and h1' with which the convex parts 28*b* of the plate spring 28 are engaged are formed in these two positions.

In FIG. 8-(B) the operations panel 120 is at the tilt angle 25 degrees. At this tilt angle, the head ends of the lock pins 36B and 36A are situated in the 25 degrees position and 205 degrees position, respectively, which are crossing points of the 25 degree line and the circumference C. Accordingly, the tilt angle of the operations panel 120 can be maintained at 25 degrees by locking the lock pins 36A and 36B against the supporting plate 16B at the 25 degrees position or 205 degrees position. However, if a hole is provided in the 205 degrees position, the hole neighbors the hole H1. Hence, a hole H2 with which the lock pin 36B is engaged is formed in the 25 degrees position. In addition, the convex parts 28*b* of the plate spring 28 are positioned in the 115 degrees position and the 295 degrees position on the circumference C. Accordingly, the hole h2 and the hole h'2 with which the convex part 28*b* is engaged are formed in these two positions.

In FIG. 9-(A) the operations panel 120 is at the tilt angle 45 degrees. At this tilt angle, the head ends of the lock pins 36B and 36A are situated in the 45 degrees position and 225 degrees position, respectively, which are crossing points of the 45 degree line and the circumference C. Accordingly, the tilt angle of the operations panel 120 can be maintained at 45 degrees by locking the lock pins 36A and 36B against the supporting plate 16B at the 45 degrees position or 225 degrees position. However, if a hole is provided in the 45 degrees position, the hole neighbors the hole H2. Hence, a hole H3 with which the lock pin 36A is engaged is formed in the 225 degrees position. In addition, the convex parts 28*b* of the plate spring 28 are positioned in the 135 degrees position and the 315 degrees position on the circumference C. Accordingly, the hole h3 and the hole h'3 with which the convex part 28*b* is engaged are formed in these two positions.

In FIG. 9-(B) the operations panel 120 is at the tilt angle 75 degrees. At this tilt angle, the head ends of the lock pins 36B and 36A are situated in the 75 degrees position and 255 degrees position, respectively, which are crossing points of the 75 degree line and the circumference C. Accordingly, the tilt angle of the operations panel 120 can be maintained at 75 degrees by locking the lock pins 36A and 36B against the supporting plate 16B at the 75 degrees position or 255 degrees position. A hole H4 with which the lock pin 36B is engaged is formed in the 75 degrees position. In addition, the convex parts 28*b* of the plate spring 28 are positioned in the 165 degrees position and the 345 degrees position on the circumference C. Accordingly, the hole h4 and the hole h4' with which the convex part 28*b* is engaged are formed in these two positions.

Next, an operation of the tilt mechanism 10 forming the angle adjusting device 130 is discussed with reference to FIG. 2, FIG. 3, FIG. 6, FIG. 8-(A), FIG. 8-(B), and FIG. 10-(A) through FIG. 10-(D).

The lock mechanism 30A has the same structure as the lock mechanism 30B other than that the moving direction is different. Hence, in the following explanation, the lock mechanism 30B is discussed as an example.

Figure 10:
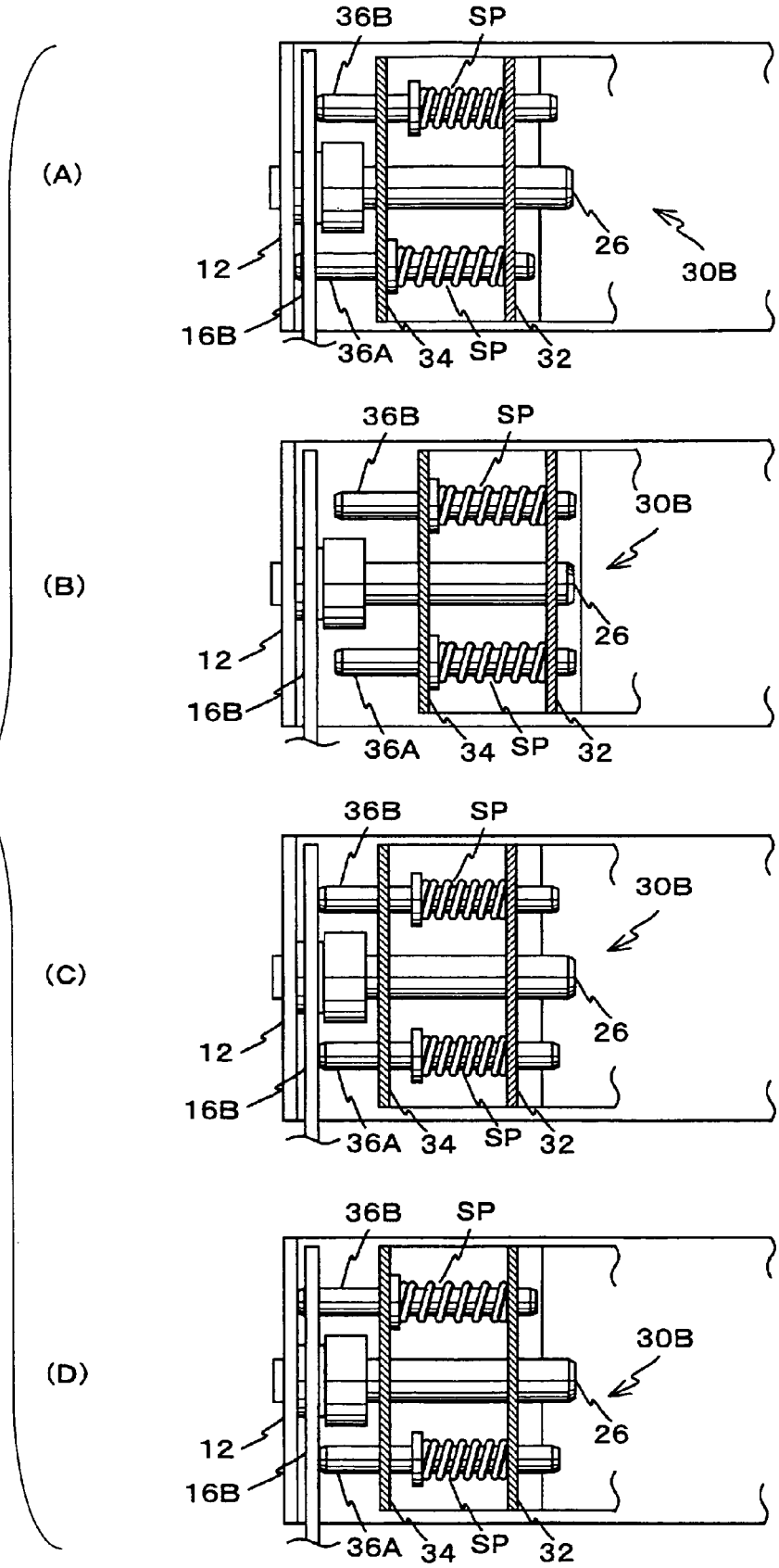
FIG. 10 is a view for explaining an operation of the angle adjusting mechanism.

It is assumed that the operations panel 120 is held, as shown in FIG. 2 and FIG. 8-(A), at the inclination angle 7 degrees, and as shown in FIG. 8-(A) and FIG. 10-(A), the lock pin 36A of the lock mechanism 30A is engaged with the hole H1 and the head end of the lock pin 36B presses the −X side of the supporting plate 16B (right side in FIG. 10-(A)) by an energizing force of the spring SP. In this state, the rotation frame 12 is fixed to the supporting plate 16B by the lock pin 36A, so that the operations panel 120 cannot be rotated.

In this state, as shown in FIG. 3, when the lever 14 is pulled in the −Y direction, namely the direction shown by an arrow, the second gear 20 meshing with the tooth part 14*f* of the lever 14 is rotated so that the first gear 22 is also rotated due to being fixed to the second gear 20. By applying a force to the tooth part 34*h* of the lock mechanism 30B meshing with the first gear 22 in a +X direction, namely the right side in FIG. 10-(B), the lock mechanism 30A is moved in the +X direction. As a result of this, as shown in FIG. 10-(B), the lock pin 36A is moved in the +X direction together with the lock pin 36B so that the lock pin 36A is pulled out from the hole H of the supporting plate 16B and the lock pin 36B is no longer pressing the supporting plate 16B. The lock pin 36A is pulled out from the supporting plate 16B so that the rotation of the supporting plate 16B and the rotation frame 12 with respect to the rotation shaft, namely the rotation of the operations panel 120 against the apparatus main body 110 is permitted.

Where the lever 14 is pulled, if the operations panel 120 is rotated, for example, at approximately 10 degrees and the lever 14 is released from the hand, the lever 14 is moved in the +Y direction in FIG. 3 by the tensile spring 13 having a spring constant sufficiently greater than the spring constant of the spring SP. As a result of this, the lock mechanism 30B is moved in the −X direction by a force applied opposite from a case when the lever 14 is pulled, namely a force on the tooth part 34*h* of the lock mechanism 30B in the −X direction. In this position, as shown in FIG. 10-(C), the lock pins 36A and 36B press the +X side of the supporting plate 16B, namely a right in FIG. 10-(C), by the force of the springs SP.

In this state, if the operations panel 120 is further rotated so that the tilt angle is 25 degrees, the lock pin 36B pressing the supporting plate 16B is, as shown in FIG. 8-(B) and FIG. 10-(D), engaged with the hole H2 by the energizing force of the spring SP. As a result of this, the rotation frame 12 is fixed to the supporting plate 16A so that the tilt angle of the operations panel 120 against the copier main body 110 is maintained at 25 degrees.

In a case where the operations panel 120 is rotated from the tilt angle 25 degrees to the tilt angle 45 degrees, the same operation is done so that the lock pin 36A is fixed to the supporting plate 16B at the tilt angle 45 degrees and the operations panel 120 is fixed at the tilt angle 45 degrees. In addition, in a case where the operations panel 120 is rotated from the tilt angle 45 degrees to the tilt angle 75 degrees, the same operation is done so that the lock pin 36B is fixed to the supporting plate 16B at the tilt angle 75 degrees and the operations panel 120 is fixed at the tilt angle 75 degrees. It is also possible to rotate the operations panel 120 without stopping the operations panel 120 on the way from the tilt angle 7 degrees to the tilt angle 75 degrees.

As discussed above, in this embodiment, the fixing member includes the base plate 111 and the supporting plates 16A and 16B. The rotation member includes the attaching plate 151 and the rotation frame 12. The slide lever includes the first member and the second member of the lock mechanisms 30A and 30B.

Furthermore, according to the angle adjusting device 130 of the embodiment of the present invention, first, the user pulls the grip part 14*a* of the lever 14 forming the setting mechanism 200. As a result of this, the second gear 20 forming the setting mechanism 200 is rotated so that the first gear 22 is also rotated together with the second gear 20. Based on the rotation of the first gear 22, the first members 34 forming the lock mechanism 30A and 30B are moved in directions in which they approach each other. The lock pins 36A and 36B are moved inside so as to be separated from the supporting plates 16A and 16B so that the lock-on state of the lock mechanisms 30A and 30B is turned off. As a result of this, the rotation of the rotation members 12 and 15 against the supporting plates 16A and 16B with respect to the rotation shaft, namely the rotation of the operations panel 120 against the apparatus main body 110, is permitted. In this state, the user operates the operations panel 120. When the angle in the up and down directions becomes closest to a designated angle or where lock-on can occur, the user releases the grip 14*a* of the lever 14 from the hand so that the lever 14 returns to the original position due to the elastic force of the tensile spring 13. As a result of this, the lock pins 36A and 36B are locked by slight rotation to the supporting plates 16A and 16B in lockable positions whose angles in up and down directions are closest to the desired angle and the operations panel 120 is maintained at the angle. Therefore, it is possible to make angle adjustment corresponding to the user of the operations panel 120 in a short period of time by an easy operation.

According to the angle adjusting device 130 of the embodiment of the present invention, plural lock pins are provided in the lock mechanism 30A and 30B. The plural lock pins are arranged in different positions on the circumference C of the supporting plate 16A or 16B so as to face each other and are always energized to press the supporting plate 16A or 16B due to the spring SP.

In other words, it is possible to adjust the angle at a lot of levels substantially equivalent to a case where the lock holes H are arranged at a gap (spacing) narrower than the diameter of the lock hole H, which adjustment is difficult to realize in the case of a single lock pin. Therefore, angle adjustment at levels whose number is the same as the case where only the single lock pin is arranged can be realized by a plate member whose area is smaller. As a result of this, the size of the device can be made small.

In a case where a single lock pin is arranged, the gap arrangement of the lock holes on the circumference should be narrow in order to adjust the angle at a lot of levels. Hence, it is necessary to secure the gap whereby neighboring lock holes are not overlapped.

On the other hand, if two lock pins are used, for example, the lock pins are provided on the same circumference in point symmetry. The neighboring first lock hole and the second lock hole are arranged on a half circle of the circle. The third hole is arranged on other half circle formed by rotating a center point between the lock hole centers at 180 degrees.

If the rotation member is rotated at a designated amount where the lock pin is engaged with the first lock hole, the other lock pin is engaged with the third lock hole. If the rotation member is further rotated, the lock pin is engaged with the second lock hole.

In the copier 100 of the embodiment of the present invention, when the user inputs the command to the operations panel 120, it is possible to adjust the operations panel 120 at an angle proper for the user. Hence, it is possible to secure good visibility and operability.

In the above-discussed embodiment, the setting mechanism 200 includes a lock-off lever 14 moving in a designated direction and a slide lever moving connected with movement of the lock-off lever 14, the lock mechanisms 30A and 30B include lock pins provided at the slide lever and plate member 16A and 16B where plural lock holes H are arranged, the lock holes H face the lock pins, and the lock pins are engaged with the lock holes along a circumference of a circle C whose center is the center of the rotation shaft. However, the structure of the angle adjusting device of the present invention is not limited to this.

For example, the angle adjusting device of the present invention may include a fixing member fixed to the apparatus main body; a rotation member where the operations panel is provided, the rotation member being provided to the fixing member so as to be rotated with respect to a designated rotation shaft in a designated angle range; a lock mechanism configured to lock rotation of the rotation member against the fixing member with respect to the rotation shaft, at plural parts or an optional part in the designated angle range, by using a force other than a frictional force between the fixing member and the rotation member; and a setting mechanism configured to set a lock-on state and lock-off state of the lock mechanism.

In this case, first, the user turns off a lock-on state of the lock mechanism by the setting mechanism. As a result of this, the rotation of the rotation member against the fixing member with respect to the rotation shaft, namely the rotation of the operations panel against the apparatus main body, is permitted. In this state, the user operates the operations panel. When the angle in the up and down directions becomes a designated angle or closest angle at which lock-on can occur, the lock mechanism is placed in the lock-on state by the setting mechanism. As a result of this, the angle of the operations panel is maintained to be the angle. Therefore, it is possible to make an angle adjustment corresponding to the user of the operations panel in a short period of time by an easy operation.

Furthermore, according to the angle adjusting device 130 of the embodiment of the present invention, first, the user pulls the grip part 14*a* of the lever 14. As a result of this, the first members 34 forming the lock mechanism 30A and 39*b* move so as to approach each other.

Then, the lock-on state of the lock mechanism 30A and 30B is turned off. As a result of this, the rotation of the rotation members 12 and 15 against the supporting plates 16A and 16B with respect to the rotation shaft, namely the rotation of the operations panel 120 against the apparatus main body 110, is permitted. In this state, the user operates the operations panel 120. When the angle in the up and down directions becomes the angle which is closest to a designated angle or wherein locking can occur, the user releases the grip 14*a* of the lever 14 from the hand so that the lever 14 returns to the original position due to the elastic force of the tensile spring 13.

After that, the operations panel 120 is rotated until reaching a desirable tilt angle so that one of the lock pins 36A and 36B is engaged with the supporting plate 16A or 16B by the energizing force of the spring SP. As a result of this, the operations panel 120 is fixed to the copier main body 110 at the designated angle.

In addition, the click mechanism, configured to rotate with the rotation frame 12 in a body and engage the supporting plates 16A and 16B at parts corresponding to the plural parts where the lock mechanisms 30A and 30B lock the rotation frame 12 against the supporting plates 16A and 16B with respect to the rotation shaft so as to generate a click sound, is formed by plural holes h formed in the supporting plates 16A and 16B and the plate spring 28, in the angle adjusting device 130.

Because of this, even if the operations panel 120 is rotated to a settable position while the lever 14 is pulled, the convex part of the click mechanism is engaged with the hole h of the supporting plate 16A and 16B so that it is possible to recognize the positional relationship between the lock pins 36A and 36B and the hole H, namely a relative position of the supporting plates 16A and 16B and the rotation frame 12 with respect to the rotation shaft, by sound or vibration. In this case, materials of surfaces of the holes h may be different so that click sound may be different depending on positions.

According to the above-mentioned copier 100 of this embodiment, since when the user inputs a command to the operations panel 120, it is possible to easily adjust the operations panel 120 to an angle proper for the user, it is possible to secure good visibility and operability.

In the above-discussed embodiment, the angle adjusting device of the present invention is applied to the copier. However, the present invention is not limited to this example. The angle adjusting device of the present invention can be applied to other types of apparatuses having an apparatus main body and an operations panel such as an image forming apparatus other than the copier, for example, a printer, facsimile, a multi functional machine of the copier and the facsimile, or a multi-functional machine of the copier and the facsimile having the function of the printer.

Furthermore, in the above-discussed embodiment, the rotation frame 12 is connected to the supporting plates 16A and 16B by the connection stick 26 via the washer 27. However, the present invention is not limited to this. For example, a member generating the energizing force in the rotation shaft direction such as a disk spring, instead of the washer 27, can be used.

In addition, in the above-discussed embodiment, the tensile spring 13 is provided so that if the user pulls the lever 14 with holding the grip part 14*a* and then the grip 14*a* is released, the tensile spring 13 energizes the lever 14 in a direction where the lever returns to the original position, namely +Y direction. However, the present invention is not limited to this. Even if the tensile spring 13 is not provided, the user moves the lever to the original position so that the operations panel 120 can be set at the designate tilt angle.

Furthermore, in the above-discussed embodiment, the holes h are formed in the supporting plates 16A and 16B so that the convex parts 28*b* of the plate spring 28 are engaged with the holes h. However, the present invention is not limited to this. The hole h may be a concave part where the convex part of the plate spring 28 can be engaged.

As discussed above, the angle adjusting device of the present invention is proper for adjusting the rotation angle in up and down directions against the apparatus main body of the operations panel. In addition, the image forming apparatus of the present invention is proper for transferring or printing the image on the paper.

According to the above-discussed embodiment, it is possible to provide an angle adjusting device configured to support an operations panel so that up and down rotation of the operations panel against an apparatus main body can be made in a designated angle range and configured to adjust a rotational angle of the operations panel in up and down directions against the apparatus main body, the angle adjusting device including:

a fixing member fixed to the apparatus main body;

a rotation member where the operations panel is provided, the rotation member being provided to the fixing member so as to be rotated with respect to a designated rotation shaft in the designated angle range;

a lock mechanism configured to lock rotation of the rotation member against the fixing member with respect to the rotation shaft, at one or more parts in the designated angle range, by using a force other than a frictional force between the fixing member and the rotation member; and a setting mechanism configured to set a lock-on state and lock-off state of the lock mechanism.

In this angle adjusting device, first, the user turns off a lock-on state of the lock mechanism by the setting mechanism. As a result of this, the rotation of the rotation member against the fixing member with respect to the rotation shaft, namely the rotation of the operations panel against the apparatus main body, is permitted. In this state, the user operates the operations panel. When the angle in the up and down directions becomes a designated angle or the closest angle at which lock-on can occur, the lock mechanism is placed in the lock-on state by the setting mechanism. As a result of this, the angle of the operations panel is the angle. Therefore, it is possible to make an angle adjustment corresponding to the user of the operations panel in a short period of time by an easy operation.

The setting mechanism may include a lock-off lever moving in a designated direction and a slide lever moving connected with movement of the lock-off lever; the lock mechanism may include a lock pin provided at the slide lever and a plate member where a plurality of lock holes is arranged; the lock holes may face the lock pin; and the lock pin may be engaged with the lock holes along a circumference of a circle whose center is a center of the rotation shaft.

The angle adjusting device may further include an energizing part configured to force the lock pin to the plate member. The angle adjusting device may further include means for energizing the lock pin move to the plate member.

A plurality of the lock pins may be provided, the lock pins may be provided at different positions on the circumference of the plate member, and the lock pins may be energized by an energizing part. A head of the lock pin may be formed in a taper shape or a spherical surface shape.

In a case where a single lock pin is arranged, an arrangement gap on the circumference of the lock hole should be narrow in order to adjust the angle at a lot of levels. Hence, it is necessary to secure the gap whereby neighboring lock holes are not overlapped.

On the other hand, if two lock pins are used, for example, the lock pins are provided on the same circumference in point symmetry. The neighboring first lock hole and the second lock hole are arranged on a half circle of the circle. The third hole is arranged on other hand circle formed by rotating a center point between the lock hole centers at 180 degrees.

If the rotation member is rotated at a designated amount where the lock pin is engaged with the first lock hole, the other lock pin is engaged with the third lock hole. If the rotation member is further rotated, the lock pin is engaged with the second lock hole.

In other words, it is possible to adjust the angle at a lot of levels substantially equivalent to a case where the lock holes are arranged at a gap narrower than a diameter of the lock hole whose realization is difficult in the case of a single lock pin. Therefore, the angle adjustment at levels whose number is the same as the case where only the single lock pin is arranged can be realized by the plate member whose area is smaller. As a result of this, the size of the device can be made small.

According to the above-discussed embodiment, it is possible to provide an image forming apparatus configured to form an image based on a command input by a user, the image forming apparatus including:

an operations panel by which the command is input;

an image forming apparatus main body configured to form the image based on the command input by the operations panel; and an angle adjusting device, the angle adjusting device being configured to support the operations panel so that up and down rotation of the operations panel against an apparatus main body can be made in a designated angle range and configured to adjust a rotational angle of the operations panel in up and down directions against the apparatus main body, the angle adjusting device including:

a fixing member fixed to the apparatus main body;

a rotation member where the operations panel is provided, the rotation member being provided to the fixing member so as to be rotated with respect to a designated rotation shaft in the designated angle range;

a lock mechanism configured to lock rotation of the rotation member against the fixing member with respect to the rotation shaft, at one ore more parts in the designated angle range, by using a force other than a frictional force between the fixing member and the rotation member; and a setting mechanism configured to set a lock-on state and lock-off state of the lock mechanism.

According to the above-mentioned image forming apparatus, the operations panel by which the user inputs the command is held against the image forming apparatus main body configured to form the image based on the command input from the operations panel by the above-discussed angle adjusting device. Therefore, since when the user inputs a command to the operations panel, it is possible to easily adjust the operations panel to a proper angle, it is possible to secure good visibility and operability.

According to the above-discussed embodiment, it is possible to provide an angle adjusting device configured to support an operations panel so that up and down rotation of the operations panel against an apparatus main body can be made in a designated angle range and configured to adjust a rotational angle of the operations panel in up and down directions against the apparatus main body, the angle adjusting device including:

a fixing member fixed to the apparatus main body;

a rotation member where the operations panel is provided, the rotation member being provided to the fixing member so as to be rotated with respect to a designated rotation shaft in the designated angle range;

a lock mechanism configured to lock rotation of the rotation member against the fixing member with respect to the rotation shaft, at plural parts in the designated angle range; and a lever reciprocating in a designated shaft direction and setting a lock-on state and a lock-off state of the lock mechanism by a moving position.

The lock mechanism may include a lock pin preventing a relative rotation of the fixing member and the rotation member at the plural parts.

The angle adjusting device may further include a click mechanism configured to rotate with the rotation member in a body and engage the fixing member at parts corresponding to the plural parts where the lock mechanism locks the rotation of the rotation member against the fixing member with respect to the rotation shaft so as to generate a click sound.

The rotation shaft of the rotation member for rotating against the fixing member may be provided at the center of gravity of the operations panel or in the vicinity of the center of gravity of the operations panel.

In this angle adjusting device, first, the user moves the lever to a side in a designated shaft direction so that a lock-on state of the lock mechanism is turned off. As a result of this, the rotation of the rotation member against the fixing member with respect to the rotation shaft, namely the rotation of the operations panel against the apparatus main body, is permitted. In this state, the user rotates the operations panel and returns the lever in a lockable position where the angle in up and down directions is closest to a desirable angle. As a result of this, the angle of the operations panel is this angle. In this case, the lever may be always energized to the other side of the designated shaft direction by using an energizing part such as a spring. Under this structure, if the user removes a hand from the lever, the lever can be returned by itself. Therefore, where the lever is moved to a side in the designated shaft direction, the operations panel is rotated in the vicinity of the position where lock-on can occur closest to the desirable angle and the lever is released from the hand. After that the operations panel is slightly rotated so that the operations panel is locked on in a position where lock-on can occur and an angle in up and down directions is closest to the desirable angle. The angle of the operations panel is this angle.

Therefore, it is possible to make an angle adjustment corresponding to the user of the operations panel in a short period of time by an easy operation.

According to the above-discussed embodiment, it is possible to provide an image forming apparatus configured to form an image based on a command input by a user, the image forming apparatus including:

an operations panel by which the command is input;

an image forming apparatus main body configured to form the image based on the command input by the operations panel; and an angle adjusting device, the angle adjusting device being configured to support the operations panel so that up and down rotation of the operations panel against an apparatus main body can be made in a designated angle range and configured to adjust a rotational angle of the operations panel in up and down directions against the apparatus main body, the angle adjusting device including:

a fixing member fixed to the apparatus main body;

a rotation member where the operations panel is provided, the rotation member being provided to the fixing member so as to be rotated with respect to a designated rotation shaft in the designated angle range;

a lock mechanism configured to lock rotation of the rotation member against the fixing member with respect to the rotation shaft, at plural parts in the designated angle range; and a lever reciprocating in a designated shaft direction and setting a lock-on state and a lock-off state of the lock mechanism by a moving position.

According to the above-mentioned image forming apparatus, the operations panel by which the user inputs the command is held against the image forming apparatus main body configured to form the image based on the command input from the operations panel by the above-discussed angle adjusting device. Therefore, since when the user inputs a command to the operations panel, it is possible to easily adjust the operations panel to a proper angle, it is possible to secure good visibility and operability.

The present invention is not limited to the above-discussed embodiments, but variations and modifications may be made without departing from the scope of the present invention.

This patent application is based on Japanese Priority Patent Application No. 2005-76323 filed on Mar. 17, 2005, and Japanese Priority Patent Application No. 2005-76326 filed on Mar. 17, 2005, the entire contents of which are hereby incorporated by reference.

What is claimed is:

1. An angle adjusting device configured to support an operations panel so that up and down rotation of the operations panel against an apparatus main body can be made in a designated angle range and configured to adjust a rotational angle of the operations panel in up and down directions against the apparatus main body, the angle adjusting device comprising:

a fixing member fixed to the apparatus main body;

a rotation member where the operations panel is provided, the rotation member being provided to the fixing member so as to be rotated with respect to a designated rotation shaft in the designated angle range;

a lock mechanism configured to lock rotation of the rotation member against the fixing member with respect to the rotation shaft, at one or more parts in the designated angle range, by using a force other than a frictional force between the fixing member and the rotation member; and a setting mechanism configured to set a lock-on state and lock-off state of the lock mechanism, wherein the setting mechanism includes a lock-off lever moving in a designated direction and a slide lever moving connected with movement of the lock-off lever;

the lock mechanism includes a lock pin provided at the slide lever and a plate member where a plurality of lock holes is arranged;

the lock holes face the lock pin; and the lock pin is engaged with the lock holes along a circumference of a circle whose center is a center of the rotation shaft.

2. The angle adjusting device as claimed in claim 1, further comprising:

an energizing part configured to force the lock pin to the plate member.

3. The angle adjusting device as claimed in claim 1, further comprising:

means for energizing the lock pin move to the plate member.

4. The angle adjusting device as claimed in claim 1, wherein a plurality of the lock pins is provided, the lock pins are provided at different positions on the circumference of the plate member, and the lock pins are energized by an energizing part.

5. The angle adjusting device as claimed in claim 1, wherein a head of the lock pin is formed in a taper shape or a spherical surface shape.

6. An angle adjusting device configured to support an operations panel so that up and down rotation of the operations panel against an apparatus main body can be made in a designated angle range and configured to adjust a rotational angle of the operations panel in up and down directions against the apparatus main body, the angle adjusting device comprising:

a fixing member fixed to the apparatus main body;

a rotation member where the operations panel is provided, the rotation member being provided to the fixing member so as to be rotated with respect to a designated rotation shaft in the designated angle range;

a lock mechanism configured to lock rotation of the rotation member against the fixing member with respect to the rotation shaft, at plural parts in the designated angle range;

a lever reciprocating in a designated shaft direction and setting a lock-on state and a lock-off state of the lock mechanism by a moving position; and a click mechanism configured to rotate with the rotation member in a body and engage the fixing member at parts corresponding to the plural parts where the lock mechanism locks the rotation of the rotation member against the fixing member with respect to the rotation shaft so as to generate a click sound.

7. The angle adjusting device as claimed in claim 6, wherein the lock mechanism includes a lock pin preventing a relative rotation of the fixing member and the rotation member at the plural parts.

8. The angle adjusting device as claimed in claim 6, wherein the rotation shaft of the rotation member for rotating against the fixing member is provided at the center of gravity of the operations panel or in the vicinity of the center of gravity of the operations panel.

* * * * *